US005362560A

United States Patent [19]

Ehrhart et al.

[11] Patent Number: 5,362,560

[45] Date of Patent: Nov. 8, 1994

[54] COMPOSITE TILE WITH MODIFIED ADHESIVE LAYER

[75] Inventors: Wendell A. Ehrhart, Red Lion; Raymond C. Kent, Lancaster, both of Pa.

[73] Assignee: Armstrong World Industries, Inc., Lancaster, Pa.

[21] Appl. No.: 63,715

[22] Filed: May 20, 1993

[51] Int. Cl.[5] ..... B32B 7/12; B32B 23/02; E04F 13/14

[52] U.S. Cl. ..... 428/343; 428/48; 428/49; 52/386; 52/387; 52/392

[58] Field of Search ..... 428/49, 48, 50, 194, 428/343; 52/387, 392, 386

[56] References Cited

U.S. PATENT DOCUMENTS

| | | | |
|---|---|---|---|
| 1,454,842 | 5/1923 | Anspach | 428/49 X |
| 2,938,376 | 5/1960 | Workman et al. | 52/386 X |
| 3,444,660 | 5/1969 | Feichter et al. | 52/392 X |
| 4,205,500 | 6/1980 | Hensley et al. | 428/49 X |
| 4,391,664 | 7/1983 | Kramer | 428/49 X |
| 4,503,654 | 3/1985 | Cosentino | 428/49 X |
| 4,567,704 | 2/1986 | Bernett et al. | 428/49 X |

FOREIGN PATENT DOCUMENTS

| | | | |
|---|---|---|---|
| 1149002 | 3/1967 | United Kingdom | 428/49 |

*Primary Examiner*—Daniel R. Zirker

[57] ABSTRACT

A rigid tile has a flexible interlocking edge configuration and a pressure-sensitive adhesive layer. To increase the ease of installation, an inert powder is dusted on the periphery of the adhesive layer.

5 Claims, 1 Drawing Sheet

Fig. 2
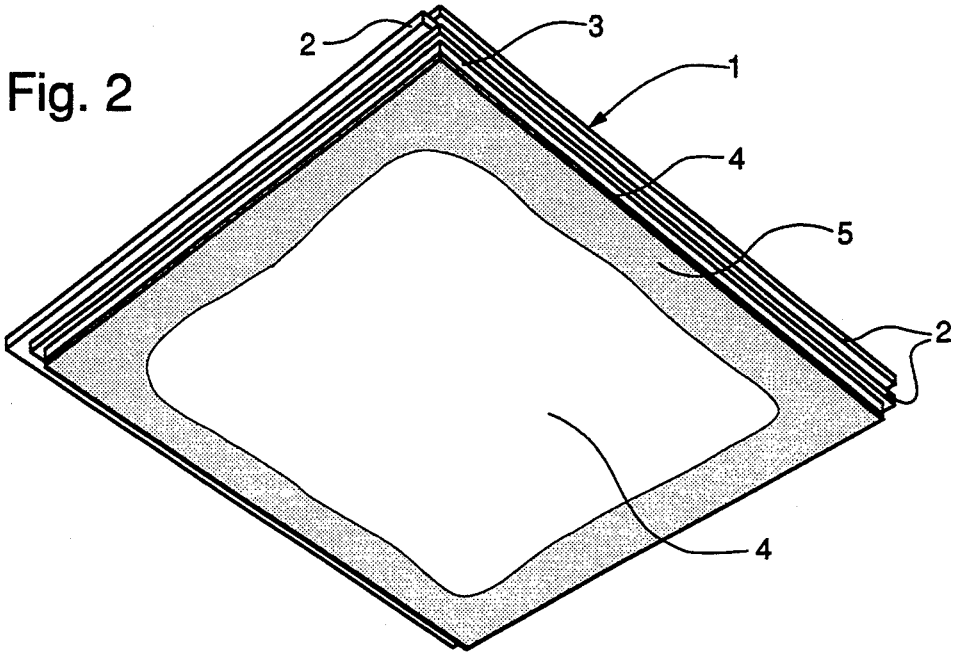
Fig. 1
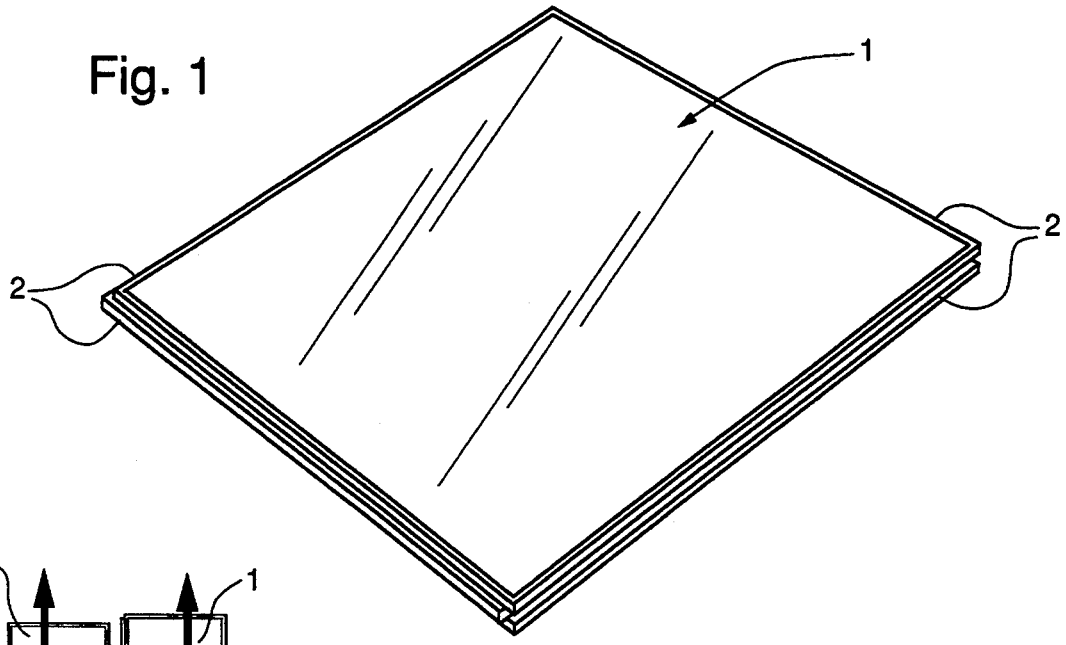
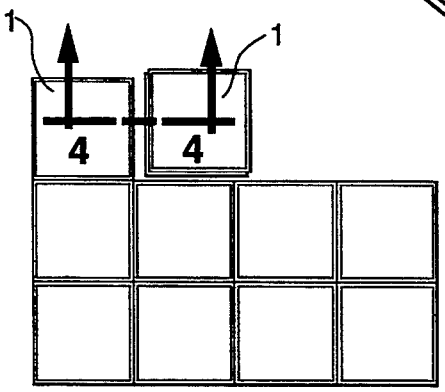
Fig. 3
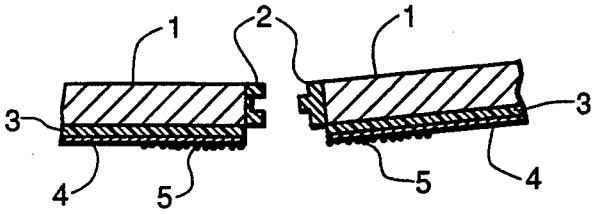
Fig. 4

COMPOSITE TILE WITH MODIFIED ADHESIVE LAYER

BACKGROUND OF THE INVENTION

This invention relates to rigid tile having a structure which promotes ease of installation. The structure may be utilized with rigid composition tile as well as ceramic tile, and is ideal for do-it-yourself (DIY) installation of rigid floor tile, wall tile and other types of tile.

Prior art systems have overcome the problem of floor surface defects by use of a foam layer. Ease of installation has been improved by the use of pressure sensitive adhesive.

Tiles have been "pre-grouted" by adhering a flexible strip such as urethane to edges of the tile. This has simplified the grouting step and has resulted in uniform grouting which only need to be sealed with a seam sealer liquid.

Uniform spacing of the tile has been accomplished by the use of interlocking tile edges, including tongue and groove edges. The interlocking edges, particularly the tongue and groove edges, have been ideal in obtaining even joints with the built-in grout edge.

However, installation problems are caused which make it difficult for the non-professional DIY installer. The pressure sensitive adhesive deters sliding of one tile alongside a previously laid tile, particularly if the edges are tongue and groove. This problem has been overcome by the present invention.

SUMMARY OF THE INVENTION

The development of a foam-backed ceramic floor tile with a pressure sensitive adhesive and tongue and groove edge gives the DIY installer a very practical way to install real ceramic floor tile. The unique feature of the present system is the dusting of the adhesive layer to allow the tile to slip into a previously installed tile. This dusting does not reduce the major bond strength to the floor which takes place more toward the center of the tile.

BRIEF DESCRIPTION OF THE DRAWINGS

FIG. 1 is a top perspective view of the rigid tile of the present invention.

FIG. 2 is a bottom perspective view of the rigid tile of the present invention.

FIG. 3 is a plan view showing one tile of the present invention being slid into position adjacent previously laid tile.

FIG. 4 is a cross-sectional view taken along line 4—4 of FIG. 3.

DETAILED DESCRIPTION OF THE INVENTION

As shown in FIGS. 1 and 4, the body of the tile is composed of a rigid material such as a ceramic. The edges 2 are made of a flexible grout material such as a urethane. The edges are preferably interlocking such as a tongue and groove or shiplap configuration. Once the tile is laid as shown in FIG. 3, the flexible edges are sealed with a seam sealer liquid.

To allow for imperfections in the substructure one which the tile is laid, a foam layer 3 is adhered to the underside of the tile body as most clearly shown in FIG. 4. Then a pressure sensitive adhesive layer 4 is adhered to the foam layer 3. The pressure sensitive adhesive permits the tile to be laid easily without the mess and necessity of trowelling an adhesive onto the substructure. However, the combination of a tongue and groove edge and the pressure sensitive adhesive has led to the problem of trying to slip the tile into place without it prematurely sticking to the substructure. Even if the tile is slightly tilted, the portion of the adhesive adjacent the leading edge contacts the substructure deterring further movement.

This problem has been overcome in the present invention by dusting the perimeter of the adhesive layer 4 with an inert powder 5 such as calcium carbonate. Other examples of useable powders include talc, fine clay and diatomaceous earth. The dusting permits the tile to be slid into position, but does not significantly reduce the bond strength of the tile to the substructure.

We claim:

1. A rigid tile comprising a first major surface, a second major surface which is opposite the first major surface and which is to be bonded to a substrate, an edge portion interposed between the first and second major surfaces, and a pressure sensitive adhesive, the first major surface being exposed when the tile is bonded to the substrate, the adhesive being coated onto the second major surface, the second major surface being divided into an inner area and an outer area adjacent the edge portion, the adhesive coated onto the outer area having a dusting of fine inert powder on the surface of the adhesive opposite the second major surface and the adhesive coated onto the inner area of the second major surface having no dusting of fine inert powder.

2. The tile of claim 1 wherein the edge portion comprises a flexible interlocking configuration.

3. The tile of claim 2 wherein the flexible interlocking edge is selected from the group consisting of a polyurethane or an epoxy.

4. The tile of claim 1 wherein a major portion of the tile comprises ceramic.

5. The tile of claim 1 wherein the fine inert powder is selected from the group consisting of calcium carbonate, talc, fine clay and diatomaceous earth.

* * * * *